US005226463A

United States Patent [19]

Mette et al.

[11] Patent Number: 5,226,463

[45] Date of Patent: Jul. 13, 1993

[54] COUNTERPRESSURE TYPE CONTAINER FILLING APPARATUS

[75] Inventors: Manfred Mette, Hamburg; Wolfgang Wilke, Hoisdorf, both of Fed. Rep. of Germany

[73] Assignee: alfill Getränketechnik GmbH, Hamburg, Fed. Rep. of Germany

[21] Appl. No.: 824,350

[22] Filed: Jan. 23, 1992

[30] Foreign Application Priority Data

Jan. 23, 1991 [DE] Fed. Rep. of Germany ..... 4101891

[51] Int. Cl.[5] ..... B65B 31/00

[52] U.S. Cl. ..... 141/39; 141/46; 141/48; 141/287

[58] Field of Search ..... 141/39, 46, 48, 40, 141/147, 287, 254, 263, 270, 281, 266, 267, 275, 277, 279, 387, 388, 392

[56] References Cited

U.S. PATENT DOCUMENTS 2,671,591 3/1954 Franz ..... 141/39

FOREIGN PATENT DOCUMENTS 3717256 12/1988 Fed. Rep. of Germany .

*Primary Examiner*—Henry J. Recla

*Assistant Examiner*—David J. Walczak

*Attorney, Agent, or Firm*—Peter K. Kontler

[57] ABSTRACT

An apparatus for admitting metered quantities of a pressurized liquid into successive containers, such as cans or bottles, has a housing which stores a supply of pressurized liquid and carries one or more combined container sealing and centering units. Each such unit has a vertically reciprocable at least partially elastomeric tubular member movable between a lower end position and an upper end position. The external surface of the annular upper end portion of the tubular member sealingly engages a cylindrical internal surface which surrounds the outlet of the housing when the tubular member assumes its lower end position, and an end face of the annular lower end portion of the tubular member is then in sealing engagement with the open top of a container to be filled. The open lower end of a conduit for compressed gas is located at the upper end of the passage within the tubular member to ensure that the upper end portion of the tubular member can be expanded into sealing engagement with the internal surface. The tubular member and the housing define an annular clearance in the upper end position of the tubular member so that the latter can be readily cleaned from the inside and from the outside.

20 Claims, 1 Drawing Sheet

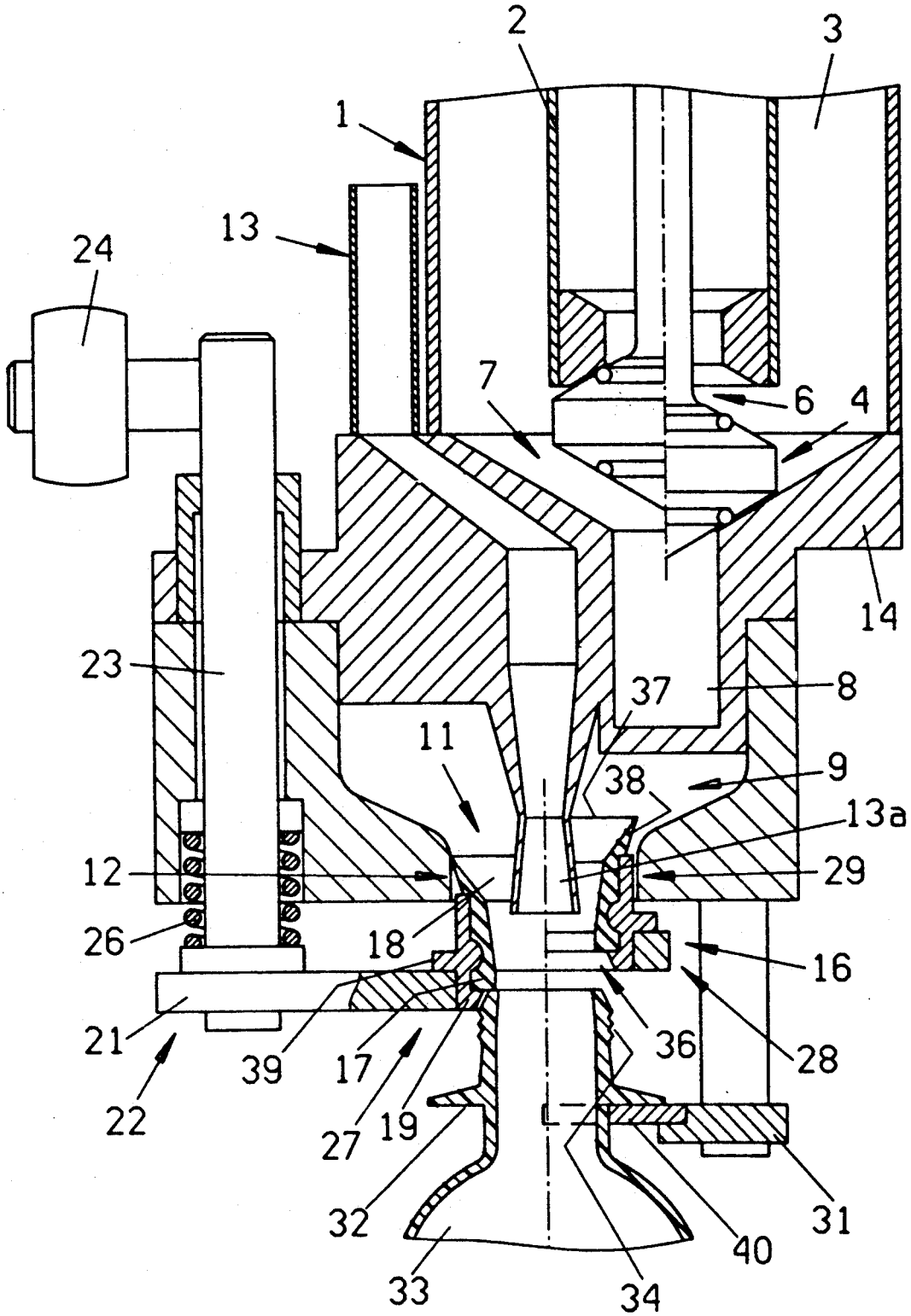
2
3
1
13
24
7
6
4
14
23
37
8
11
38
9
13a
12
29
26
18
16
21
39
17
36
28
22
27
19
32
31
40
33
34

COUNTERPRESSURE TYPE CONTAINER FILLING APPARATUS

BACKGROUND OF THE INVENTION

The invention relates to improvements in socalled counterpressure type container filling apparatus. More particularly, the invention relates to improvements in apparatus of the type disclosed in commonly owned copending patent application Ser. No. 07/568,273 filed Aug. 15, 1990 by Manfred Mette for "Apparatus for filling bottles and the like", in commonly owned copending patent application Ser. No. 07/675,428 filed Mar. 26, 1991 by Jacek Walusiak for "Apparatus for admitting metered quantities of liquid into bottles or other containers", and in commonly owned copending patent application Ser. No. 07/687,453 filed Apr. 18, 1991 by Manfred Mette for "Apparatus for filling bottles with a liquid".

Apparatus of the character to which the present invention pertains employ so-called container centering and sealing units which are mounted at the underside of a preferably rotary vessel or tank for a supply of liquid to be dispensed and for a supply of a compressed gaseous fluid, such as carbon dioxide gas. The vessel has outlets, one for each combined centering and sealing unit, to discharge metered quantities of liquid into containers while the open tops of such containers are properly engaged by the respective units. Gas conveying conduits are provided to admit compressed gas into the containers prior to admission of a liquid (such as a carbonated beverage) and to permit evacuation of gas from containers in the course of the filling step. The mode of operation is preferably such that the pressure in a container (such as a bottle or a can) can be maintained above atmospheric pressure upon completion of the filling step. As a rule, the combined centering and sealing units are installed at the underside or around the circumference of a tank which is indexible or is continuously rotatable about a substantially vertical axis and confines a supply of pressurized liquid, normally a body of liquid beneath a cushion of compressed gas. The manner in which the conduits are connected with the tank so that they can receive compressed gas from or can admit compressed gas into the aforementioned cushion is described in the above-identified copending applications to which reference may be had, if necessary. The flow of gaseous fluid in the conduits is or can be controlled by suitable valves.

Each combined centering and sealing unit is or can be provided with, or can be connected to, a liquid metering chamber and can carry or cooperates with various moving, actuating, sealing and/or other devices which become operative during selected stages of each container filling operation.

The centering operation can be carried out by tulip-shaped centering elements which engage the open tops of containers to be filled with a liquid and seal the open tops from the atmosphere in the course of the pressurizing and filling steps. The centering elements can constitute fixedly mounted parts of the respective combined centering and sealing units; this can be seen by referring, for example, to published German patent application No. 37 17 256. A container to be filled is lifted from below toward engagement with the stationary centering element of the respective combined sealing and centering unit and is pressed against a washer or another sealing element with a force which suffices to ensure adequate sealing of the container from the atmosphere until after completion of the filling operation. It is also known to lower the centering element onto the open top of a container below it, i.e., while the level of the empty container remains at least substantially unchanged. Each combined sealing and centering unit then comprises means for raising and lowering the respective centering element which latter is mounted on the casing of the respective unit. A drawback of those apparatus which employ vertically movable centering elements is that each unit must be provided with seals which are engaged by mobile parts so that the wear upon the seals is extensive, especially if such seals are utilized in the combined centering and sealing units of a modern container filling apparatus which is designed to fill large or very large numbers of containers per unit of time. Another drawback of such apparatus is that the cost of each combined centering and sealing unit is very high, and this is attributable in part to the need for accurate guide means which serve to confine the mobile centering element of each unit to reciprocatory movements along accurately determined paths, i.e., with a minimum of stray movement.

A drawback which is common to all presently known container filling apparatus of the above outlined character is that it is difficult to gain access to the centering and/or other elements or components of the combined centering and sealing units. Thus, it is necessary to dismantle the apparatus whenever the operators decide that the aforementioned units or certain parts of such units require a thorough cleaning or rinsing, e.g., prior to conversion of the apparatus for the filling of containers with a different liquid. Since a modern container filling apparatus normally comprises a very large number of combined centering and sealing units, even a partial dismantling of each such unit prior to a cleaning operation and reassembly of such units upon completion of a cleaning operation takes up much time with attendant considerable losses in output. In many instances, dismantling and reassembly of combined centering and sealing units must be carried out by skilled workers.

OBJECTS OF THE INVENTION

An object of the invention is to provide a novel and improved container filling apparatus wherein the parts which necessitate inspection and/or cleaning at certain intervals are more readily accessible than in heretofore known apparatus.

Another object of the invention is to provide the apparatus with novel and improved combined container sealing and centering units.

A further object of the invention is to provide the apparatus with combined container centering and sealing units which can be made accessible for cleaning without even partial dismantling of the respective units.

An additional object of the invention is to provide the apparatus with combined container centering and sealing units which render it possible to gain access to and to clean or inspect certain parts of such units with little loss in time.

Still another object of the invention is to provide an apparatus which simplifies the application of the aforementioned units to the open tops of empty containers and the disengagement of such units from the open tops of freshly filled containers.

An additional object of the invention is to provide novel and improved combined centering and sealing units which can be assembled with the liquid-containing vessels of existing apparatus as superior substitutes for existing units.

Another object of the invention is to provide a novel and improved method of sealing the open tops of containers, such as bottles, in a container filling apparatus of the above outlined character.

A further object of the invention is to provide an apparatus wherein the cleaning of container-contacting parts takes up less time than in heretofore known apparatus.

An additional object of the invention is to provide an apparatus wherein the gas conveying conduits can perform certain additional important functions, particularly as concerns the sealing of open tops of containers prior to as well as in the course of admission of metered quantities of a liquid (such as a carbonated) beverage) into the containers.

Another object of the invention is to provide a novel and improved apparatus for filling containers of the type having external collars or like extensions adjacent their open tops.

SUMMARY OF THE INVENTION

The invention is embodied in a counterpressure type apparatus for admission of a liquid (such as a carbonated beverage) into containers having open tops, for example, into bottles having external collars adjacent their open tops. The improved apparatus comprises a housing which serves to store a supply of pressurized liquid and has a liquid discharging outlet and a preferably at least substantially cylindrical internal surface surrounding the outlet, and a container sealing and centering unit which is supported by the housing and includes a tubular member defining a passage having a receiving end extending into the outlet of the housing and a discharge end for admission of liquid through the open top of a container. The tubular member has a first annular portion which is disposed at the receiving end of the passage and is movable into and from sealing engagement with the internal surface of the housing, and a second annular portion which is disposed at the discharge end of the passage and is sealingly engageable by the open top of a container.

The apparatus preferably further comprises a gas conveying conduit which is provided in or on the housing and has an open end in communication with a container while the open top of such container sealingly engages the second annular portion of the tubular member.

At least the first annular portion of the tubular member can consist of rubber or another suitable elastomeric material. The aforementioned conduit is connected to a source of compressed gas in the housing and the open end of such conduit is located at the first annular portion so that the compressed gas which issues from the open end of the conduit can deform the first portion of the tubular member into sealing engagement with the internal surface of the housing. The entire tubular member can be made of an elastomeric material and its second annular portion can be provided with an annular face which surrounds the discharge end of the passage and can be sealingly engaged by the open top of a container which is to receive a preferably metered quantity of liquid.

It is presently preferred to provide the tubular member with a substantially funnel-shaped passage having a crosssectional area which diminishes in a direction from the first toward the second annular portion of the tubular member. The housing can be provided with a liquid swirling chamber having a discharge end in communication with the liquid discharging outlet. The passage of the tubular member can constitute an extension of the swirling chamber so that the liquid which flows through and is set into circulatory motion in the swirling chamber continues to remain in circulatory motion during flow through the passage of the tubular member and into a container which engages the second annular portion of the tubular member.

The tubular member is preferably reciprocable in the direction of its central axis between a first position in which the first annular portion is in sealing engagement with the internal surface of the housing and a second position in which the first annular portion is spaced apart from the internal surface. The diameter of the external surface of the first annular portion of the tubular member can approximate the diameter of the internal surface of the housing. The tubular member includes a third annular portion which is disposed between the first and second annular portions and is adjacent the first annular portion. The diameter of the annular external surface of the third annular portion is preferably smaller than the diameter of the external surface of the first annular portion. The apparatus further comprises means for moving the tubular member relative to the housing between the first and second positions. The internal surface of the housing and the external surface of the third annular portion of the tubular member define a preferably annular clearance when the tubular member is moved to the second position, and the external surface of the first annular portion is then spaced apart from the internal surface of the housing.

If the tubular member consists, at least in part, of an elastomeric material, the aforementioned sealing and centering unit preferably further comprises an at least substantially rigid stabilizing device for the tubular member. Such stabilizing device can at least partially surround the tubular member, preferably in such a way that the first annular portion of the tubular member extends beyond the stabilizing device. The first annular portion is preferably expandible (by compressed gas) into sealing engagement with the internal surface of the housing. The diameter of the external surface of the first annular portion (in unexpanded condition of such first annular portion) is then less than the diameter of the internal surface of the housing.

If the apparatus is to fill containers which are provided with external collars adjacent to their open tops, the apparatus preferably further comprises a support for the collar of a container which is about to receive a liquid through the passage of the tubular member. The second annular portion sealingly engages the open top of a container having an external collar engaged by the support when the tubular member is moved to the first position in which the external surface of its first annular portion sealingly engages the internal surface of the housing. The support is located beneath the housing and the tubular member is preferably movable vertically to and from its two positions. The support can be fixedly or adjustably connected to the housing, and the means for moving the tubular member can be mounted on the housing. The latter is preferably movable along an endless path and can be provided with a plurality of outlets and can carry an equal number of combined sealing and centering units.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a fragmentary schematic vertical sectional view of an apparatus which embodies one form of the present invention, the left-hand half of the combined container sealing and centering unit being shown in a first position in which the tubular member sealingly engages the internal surface of the housing at the liquid discharging outlet and the right-hand half of the unit being shown in a second position in which the unit is ready to be cleaned.

DESCRIPTION OF PREFERRED EMBODIMENTS

The drawing shows a portion of a container filling apparatus with a single combined container centering and sealing unit 16 at the underside of the lower portion or base 14 of a housing 1, e.g., a housing at the underside of a vessel or tank 2 which can be indexed or rotated about a substantially vertical axis and carries an entire annular array of neighboring units 16. Reference may be had to the aforementioned commonly owned copending patent applications. As can be seen in FIG. 5 of the copending application Ser. No. 07/568,273, an annular vessel or tank can carry a large number of combined centering and sealing units each of which advances first past a container engaging station where a sealing member in each unit engages the open top of an empty container and thereupon past a container releasing station where successive filled containers are disengaged from the respective sealing members. Pressurizing of each container with a suitable gas, filling of each container with a liquid and, in certain instances, capping of each filled container takes place during advancement of the respective units from the engaging station to the releasing station.

The illustrated housing 1 is installed beneath or forms part of the tank or vessel 2 for a supply of liquid (e.g., a carbonated beverage). The housing receives liquid from the main source of supply and has a liquid discharging outlet 11 directly above the combined sealing and centering unit 16 so that the liquid which is dispensed via outlet 11 is compelled to flow through a substantially funnel-shaped downwardly tapering passage 18 which is defined by a vertically reciprocable tubular centering and sealing member 17. A gas conveying conduit 13 is provided with an open lower end **13*a* within the central zone of the annular upper end portion 37 of the member 17, and the upper end portion of this conduit extends into a cushion of compressed gas above the body of liquid in the vessel 2. The character 3 denotes a metering chamber which is filled with a predetermined quantity of liquid prior to lifting of a vertically movable valve 4 so that the valve moves from a lower end position to an upper end position in which the valve seals an annular passage 6 between the vessel 2 and the metering chamber 3. At the same time, the valve 4 establishes a path 7 for the flow of metered quantity of liquid from the chamber 3 into an empty container 33 (e.g., a plastic bottle) having an open top 34 which is then sealingly engaged by the lower end portion 36 of the tubular member 17. The valve 4** is of the type described and shown in the aforementioned copending patent application Ser. No. 07/675,428 of Walusiak.

The right-hand half of the valve 4 is shown in the lower end position in which the metering chamber 3 is sealed from the path 7 and outlet 11. The left-hand half of the valve 4 is shown in the upper end position in which the metering chamber 3 is sealed from the interior of the vessel 2 but is free to discharge its contents into the container 33 which has its open top 34 in sealing engagement with the lower end portion 36 of the tubular member 17. Analogously, the right-hand half of the tubular member 17 is shown in a raised or upper end position in which the upper end portion 37 of this member is spaced apart from a preferably cylindrical internal surface 12 in the base 14 of the housing 1, and the left-hand half of the member 17 is shown in the lower end position in which the upper end portion 37 sealingly engages the internal surface 12 and an annular bottom face of the lower end portion 36 of the member 17 sealingly engages the adjacent annular face at the open top 34 of the container 33.

The path 7 serves to deliver a metered quantity of liquid into a liquid swirling or circulating channel or chamber 8 having a discharge end in communication with the upper end of the funnel-shaped passage 18 so that the metered quantity of liquid which begins to circulate in the chamber or channel 8 on its way from the metering chamber 3 into the passage 18 continues to remain in circulatory motion all the way into the interior of the container 33. The swirling chamber or channel 8 is similar to that disclosed in the aforementioned copending patent application Ser. No. 07/687,453 of Matte.

At least a portion of the tubular member 17 is made of rubber or another suitable elastomeric material. At the very least, the upper end portion 37 (which is movable into and from sealing engagement with the surface 12 in the base 14 of the housing 1) can be made of an elastomeric material. The inner diameter of the end portion 37 can match the outer diameter of the annular outlet 11, at least in the lower end position of the member 17. If the diameter of the external surface of the upper end portion 37 is somewhat smaller than the diameter of the surface 12 when the member 17 assumes the lower end position and is not deformed, compressed gas which is supplied by the open lower end **13*a* of the conduit 13 causes the upper end portion 37 to expand into requisite sealing engagement with the surface 12 in the course of each container pressurizing and filling operation. The unit 16 preferably further comprises an at least substantially rigid sleeve-like stabilizing device 19 which surrounds the major part of the tubular member 17 save for the upper end portion 37 and a relatively short third portion 38 adjacent the end portion 37. The diameter of the external surface of the portion 38 is somewhat less than the diameter of the surface 12 so that, when the member 17 is lifted to its upper end position, the end portion 37 and the adjacent portion 38 of the member 17 define with the surface 12 an annular clearance 29 which permits convenient cleaning of the exterior of the unit 16. The clearance 29 extends downwardly along the adjacent upper end portion of the stabilizing device 19, as long as the member 17 (i.e., the entire unit 16**) is maintained in the upper end position.

The supporting device 19 has an external collar 39 which cooperates with an arm 21 of a device 22 serving as a means for moving the member 17 between its upper and lower end positions during predetermined stages of each cycle, i.e., during predetermined stages of each complete revolution of the unit 16 about the vertical axis of the vessel 2. The moving device 22 further comprises a vertically movable motion transmitting member 23 which is biased in a downward direction by a stressed coil spring 26 and is reciprocable in a bore or hole of the housing 1. The upper end portion of the member 23 carries a roller follower 24 which can track a stationary cam (e.g., a groove cam, not shown) adjacent the path of movement of the vessel 2 about its vertical axis to effect an upward movement of the unit 16 against the opposition of the spring 23 or to enable the spring 23 to move the unit 16 to the lower end position. The lower end position of the arm 21 is shown at 27, and the upper end position of this arm is shown at 28.

When the unit 16 is maintained in the upper end position (corresponding to the position 28 of the arm 21), the entire unit 16 can be readily cleaned from within and from without, e.g., by resorting to a hose or by causing a cleaning or rinsing liquid to flow through the swirling chamber or channel 8 and through the passage 18 as well as through the annular clearance 29. Such cleaning does not necessitate even partial dismantling of the unit 16.

The base 14 of the housing 1 carries a support 31 which can engage from below the external collar 32 of the container 33 in the course of a filling operation. This enables the lower end portion 36 of the tubular member 17 to bear against the open top 34 of the container 33 with a force which is necessary to prevent escape of liquid and/or compressed gas between 34 and 36 while the container 33 is in the process of receiving a metered quantity of carbonated beverage or another liquid. The containers 33 can be standard PET bottles or bottles made from another suitable material. The support 31 can be vertically movably and/or turnably mounted on the housing 1. However, such movements of the support 31 are not necessary in the illustrated apparatus because the lower end portion 36 of the tubular member 17 is free to descend into sealing engagement with the open top 34 after the collar 32 of the container has been caused to overlie the adjacent platform 40 of the support 31.

The mode of operation is as follows:

The first step involves the delivery of an empty container 33 into the range of the illustrated portion of the apparatus so that the underside of the external collar 32 of the then empty container comes to rest on the upper side of the platform 40 of the support 31. The platform 40 maintains the empty container 33 in a position of at least substantial axial alignment with the centering member 17 and with the outlet 11 of the housing 1. The moving device 22 is thereupon actuated to lower the member 17, i.e., the upper end portion 37 of the member 17 sealingly engages or is ready to sealingly engage the surface 12 and the lower end portion 36 is in sealing engagement with the open top 34 of the container 33 which is held by the support 31. The arrangement can be such that the diameter of the external surface of the upper end portion 37 in the lower end position of the member 17 is slightly less than the diameter of the internal surface 12; this reduces or eliminates friction between the member 17 and the lower portion or base 14 of the housing 1 during movement of the member 17 to its lower end position. Absence of frictional engagement between the end portion 37 and the surface 12 during downward movement of the unit 16 prolongs the useful life of the member 17 and ensures that such member can stand long periods of use.

The open end **13*a* of the conduit 13 then admits a supply of compressed gas (e.g., carbon dioxide gas) which enters the container 33 as well as the upper end portion of the passage 18 so that the readily deformable upper end portion 37 of the member 17 expands into sealing engagement with the surface 12 to prevent escape of compressed gas and/or of pressurized liquid. At such time, the valve 4 is maintained in the lower end position to seal the metered quantity of liquid in the chamber 3 from the passage 18. The gaseous fluid which is admitted via conduit 13 equalizes the pressure in the entire illustrated portion of the apparatus while simultaneously ensuring that the end portion 37 is maintained in requisite sealing engagement with the surface 12. Proper sealing engagement between the lower end portion 36 of the member 17 and the open top 34 of the container 33 is established and maintained by the coil spring 26 which is then free to maintain the arm 21 in the lower end position 27. The action of the spring 26 is or can be assisted by compressed gas which is supplied by the conduit 13, i.e., such compressed gas not only urges the end face 37 into sealing engagement with the surface 12 but can also urge the lower end portion 36 of the member 17 into sealing engagement with the portion 34 of the container 33**.

The valve 4 is then caused to move to the upper end position in which the contents of the metering chamber 3 can flow into the path 7 and thence into the container 33 via passage 18. Such movement of the valve 4 to its upper end position takes place subsequent to complete filling of the chamber 3 with a liquid which is stored in the tank 2. The metered quantity of liquid is set in circulatory motion during flow through the swirling chamber or channel 8, and such circulatory movement continues to take place along the internal surface of the member 17 as well as during flow in the neck portion of the container 33. The liquid which flows into the container 33 expels the gaseous fluid which is caused to enter the open lower end **13*a* of the conduit 13 and to flow back into the cushion above the body of liquid in the tank 2**.

The valve 4 is caused to reassume its lower end position (to seal the chamber 3 from the path 7) as soon as the filling of the container 33 with a metered quantity of liquid is completed, i.e., the metering chamber 3 is then free to receive fresh liquid which enters this chamber through the annular passage 6. At the same time, the passage 18 is connected with the atmosphere (e.g., in a manner as described and shown in the aforementioned copending patent applications) and the device 22 is thereafter caused to lift its arm 21 to the position 28 so that the lower end portion 36 of the tubular member 17 is disengaged from the top 34 of the freshly filled container 33. This renders it possible to disengage the filled container from the platform 40 of the support 31 at the aforementioned container releasing station. An empty container 33 is delivered to assume the position of the illustrated container as soon as the unit 16 reaches the aforementioned container engaging station.

The funnel-shaped configuration of the surface bounding the passage 18 of the tubular member 17 ensures that compressed gas at the open end **13*a*** of the conduit 13 urges the upper end portion 37 into sealing engagement with the surface 12 as well as that the lower end portion 36 is urged downwardly into sealing engagement with the top 34 of the adjacent container 33. This is due to the fact that compressed gas can act upon the end portion 37 radially outwardly while, at the same time, urging the entire tubular member 17 and hence the lower end portion 36 downwardly toward sealing engagement with the container 33 which is held by the platform 40 of the support 31. Thus, the member 17 can sealingly engage the surface 12 and a container 33 without the need for any sliding movement between such member on the one hand, and the base 14 and the container 33 on the other hand.

Another important advantage of the combined centering and sealing unit 16 is that it does not establish any dead corners which would store quantities of liquid and would be hard to clean in the raised position of the member 17. Therefore, simple rinsing with water or with another liquid suffices to properly clean the unit 16 from the outside as well as from within, and this takes place without any agitation of cleaning liquid. All that is necessary is to lift the arm 21 to the position 28 in order to establish the clearance 29, and the entire unit 16 is ready for cleaning by a liquid which can flow through the clearance 29 as well as through the passage 18. The cleaning liquid can be admitted via swirling chamber or channel 8 so that such liquid enters the clearance 29 as well as the passage 18 from above. As mentioned hereinbefore, cleaning of the unit 16 does not necessitate even partial dismantling of the apparatus but merely a step (lifting of the arm 21 to the position 28) which is also carried out in the course of each filling cycle, namely to permit an empty container 33 to assume the illustrated position.

A further important advantage of the improved unit 16 is that neither this unit nor the vessel 2 must be provided with accurately machined and/or otherwise shaped guide means for the tubular member 17. This is due to the fact that the member 17 is elastic, at least in part, and can sealingly engage the surface 12 as well as the top 34 of a container 33 by the simple expedient of lowering the arm 21 to the position 27 and admitting a compressed gas via conduit 13. This compels the upper end portion 37 of the member 17 to sealingly engage (or to remain in sealing engagement with) the internal surface 12 while simultaneously compelling the lower end portion 36 to sealingly engage (or to remain in sealing engagement with) the top 34 of the container 33 which is held by the platform 40 of the support 31.

The apparatus of the present invention can be used with particular advantage for the filling of containers in the form of cans or bottles which exhibit a relatively small resistance to deformation (PET bottles are typical examples of such containers). The reason is that simple deformation of the preferably elastic member 17 by compressed gas suffices to ensure satisfactory sealing engagement with the surface 12 as well as with the top of a container to be filled, i.e., the apparatus relies on the pressure differential between the interior and the exterior of the member 17 to ensure proper sealing of the outlet 11 from the atmosphere as well as proper sealing of the inlet of the container which is to receive a quantity of carbonated beverage or another liquid.

Still further, the combined sealing and centering unit 16 is simple, compact and inexpensive and can be installed in or on existing tanks for supplies of carbonated beverage or another liquid. Absence of the need for even partial dismantling preparatory to cleaning is particularly important when a bottle filling apparatus comprises a large number of combined sealing and centering units, i.e., when even partial dismantling prior to cleaning and renewed assembly upon completion of the cleaning step would take up considerable amounts of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A counterpressure type apparatus for admission of a liquid into containers having open tops, comprising a housing for a supply of pressurized liquid, said housing having a liquid discharging outlet and a surface surrounding said outlet; and a container sealing and centering unit supported by said housing and including a tubular member defining a passage having a receiving end extending into said outlet and a discharge end for admission of liquid through the open top of a container, said member having a first annular portion disposed at said receiving end and movable into and out of sealing engagement with said surface and a second annular portion disposed at said discharge end and sealingly engageable by the open top of a container.

2. The apparatus of claim 1, further comprising a gas conveying conduit provided in said housing and having an open end in communication with a container while the open top of such container sealingly engages the second annular portion of said member.

3. The apparatus of claim 2, wherein at least said first portion of said member consists of an elastomeric material.

4. The apparatus of claim 3, wherein said conduit is connected with a source of compressed gas in said housing and said open end of said conduit is located at said first portion so that compressed gas which issues from said open end can deform said first portion into sealing engagement with said surface.

5. The apparatus of claim 1, wherein said member consists of an elastomeric material and said second portion of said member has an annular face surrounding said discharge end and being sealingly engageable by the open top of a container.

6. The apparatus of claim 1, wherein said passage is substantially funnel shaped and has a crosssectional area which diminishes in a direction from the first portion toward the second portion of said member.

7. The apparatus of claim 6, wherein said housing has a liquid swirling chamber with a discharge end in communication with said outlet.

8. The apparatus of claim 7, wherein said passage constitutes an extension of said swirling chamber so that the liquid flowing through and being set into circulatory motion in said chamber continues to remain in circulatory motion during flow through said passage and into a container which engages the second portion of said member.

9. The apparatus of claim 1, wherein said tubular member is reciprocable relative to said housing between a first position in which said first portion is in sealing engagement with said surface and a second position in which said first portion is spaced apart from said surface.

10. The apparatus of claim 1, wherein said surface is an annular internal surface having a first diameter and said first portion has an annular external surface with a second diameter at least approximating said first diameter.

11. The apparatus of claim 10, wherein said member includes a third annular portion disposed between said first and second annular portions, adjacent said first portion and having an annular external surface with a third diameter smaller than said second diameter.

12. The apparatus of claim 11, further comprising means for moving said member axially relative to said housing between a first position in which the external surface of said first portion is in sealing engagement with said internal surface and a second position in which said internal surface and the external surface of said third portion define an annular clearance and the external surface of said first portion is disengaged from said internal surface.

13. The apparatus of claim 1, wherein said tubular member consists at least in part of an elastomeric material and said unit further comprises a substantially rigid stabilizing device for said member.

14. The apparatus of claim 13, wherein said stabilizing device partially surrounds said member.

15. The apparatus of claim 14, wherein said first portion extends beyond said stabilizing device.

16. The apparatus of claim 1, wherein at least said first portion of said member is expandible into sealing engagement with said surface, said first portion having an external surface with a first diameter and said surface of said housing having a diameter greater than said first diameter in unexpanded condition of said first portion.

17. The apparatus of claim 1, wherein said surface is a substantially cylindrical internal surface of said housing.

18. The apparatus of claim 1 for admission of liquids into containers having external collars adjacent the open tops thereof, further comprising a support for the collar of a container which is about to receive a liquid through said passage, said tubular member being movable axially to and from a position in which said first portion sealingly engages said surface while said second portion sealingly engages the open top of a container having a collar abutting said support.

19. The apparatus of claim 18, wherein said support is located beneath said housing and said member is movable substantially vertically to and from said position.

20. The apparatus of claim 19, further comprising means for moving said member relative to said housing to and from said position.

* * * * *